US008087958B2

(12) United States Patent
Yukishima et al.

(10) Patent No.: US 8,087,958 B2
(45) Date of Patent: Jan. 3, 2012

(54) BOAT PROPULSION SYSTEM

(75) Inventors: Kenji Yukishima, Shizuoka (JP); Hiroyuki Tsunekawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 293 days.

(21) Appl. No.: 12/367,671

(22) Filed: Feb. 9, 2009

(65) Prior Publication Data

US 2009/0209147 A1 Aug. 20, 2009

(30) Foreign Application Priority Data

Feb. 18, 2008 (JP) ..... 2008-035872

(51) Int. Cl.
*B63H 20/14* (2006.01)

(52) U.S. Cl. ..... 440/75
(58) Field of Classification Search ..... 440/75
See application file for complete search history.

(56) References Cited

U.S. PATENT DOCUMENTS 5,006,084 A * 4/1991 Handa ..... 440/75
6,123,591 A * 9/2000 Onoue ..... 440/75
6,547,613 B1 * 4/2003 Onoue et al. ..... 440/83

FOREIGN PATENT DOCUMENTS

JP 09-301282 A 11/1997
JP 11-129988 A 5/1999

* cited by examiner

*Primary Examiner* — Stephen Avila
(74) *Attorney, Agent, or Firm* — Keating & Bennett, LLP

(57) ABSTRACT

A boat propulsion system includes a drive bevel gear fixed on a lower end of a drive shaft, a forwarding bevel gear and a reversing bevel gear rotatably fitted on a propeller shaft and meshing together with the drive bevel gear, and a dog clutch mounted on the propeller shaft and rotatable with the propeller shaft, moves in an axial direction of the propeller shaft, and meshes together with the forwarding bevel gear or the reversing bevel gear to rotate the propeller shaft, in which the propeller shaft comes in contact with the forwarding bevel gear via a forwarding side buffer member having a disc spring as a component member. The boat propulsion system prevents and minimizes sound and impact even when variations in thrust force occur.

14 Claims, 4 Drawing Sheets

BOAT PROPULSION SYSTEM

BACKGROUND OF THE INVENTION

1. Field of the Invention

The present invention relates to a boat propulsion system.

2. Description of the Related Art

A boat propulsion system mounted on an outboard motor or the like generates the propulsive force necessary to move a boat. For example, as described in JP-A-Hei 9-301282 and JP-A-Hei 11-129988, in which an engine rotates a drive shaft that extends vertically, a rotational direction conversion mechanism uses a bevel gear to convert rotation of the drive shaft into rotation of a propeller shaft that extends horizontally, and a propeller mounted on the propeller shaft is driven to rotate.

A forwarding bevel gear or a reversing bevel gear meshes together with a dog clutch in the rotational direction conversion mechanism mentioned above. The propeller shaft is thereby provided with rotation of the forward side or rotation of the reverse side. In other words, a forwarding-reversing shift mechanism, which is a portion of the rotational direction conversion mechanism, makes the dog clutch mesh together with either one of the bevel gears to cause the boat to travel forward or to travel backward from a neutral state where the dog clutch does not mesh together with either of the bevel gears.

In the conventional art mentioned above, there is a problem in which a thrust force applied to the propeller shaft varies according to changes in drive force of the engine. When an operation is performed to keep the engine operating at a certain rotational speed, variations in rotation and in torque of the engine are generated, which generates variations in a drive force of the propeller. Thus, variations in thrust force are generated. If variations in thrust force are generated as described above, the bevel gear and the propeller shaft come in contact with each other or separate from each other at a portion where the bevel gear and the propeller shaft meet. It has become known that a user's comfort is reduced by sound and vibration that occur every time the contact is made. Sound and vibration of an engine are large in the case of two-cycle engines. Therefore, sound and vibration caused by variations in thrust force do not draw attention. However, engine sound and vibration are smaller in four-cycle engines. Therefore, sound and vibration caused by variations in thrust force in four-cycle engines draw the attention of the users.

SUMMARY OF THE INVENTION

In order to overcome the problems described above, preferred embodiments of the present invention provide a boat propulsion system that can weaken, minimize, and prevent sound and impact even when variations in thrust force occur.

A boat propulsion system according to a preferred embodiment of the present invention includes a drive bevel gear fixed on a lower end of a drive shaft that rotates in one direction, a forwarding bevel gear and a reversing bevel gear rotatably fitted on a propeller shaft and meshing together with the drive bevel gear, and a dog clutch mounted on the propeller shaft and rotatable with the propeller shaft that moves in an axial direction of the propeller shaft and meshes together with the forwarding bevel gear or the reversing bevel gear to rotate the propeller shaft, in which the propeller shaft is arranged to contact with the forwarding bevel gear via a forwarding side buffer member, and the forwarding side buffer member includes at least an elastic member that is arranged to be elastically deformed between the propeller shaft and the forwarding bevel gear as a component member.

In this construction, the elastic member absorbs and mitigates the impact caused by a collision between the propeller shaft and the forwarding bevel gear when variations in thrust force occur.

According to a preferred embodiment of the present invention, the elastically deformable elastic member is preferably disposed between the propeller shaft and the forwarding bevel gear. Consequently, even if variations in thrust force occur, generation of impact and vibration can be minimized and prevented.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter in detail with reference to the accompanying drawings.

Figure 1:
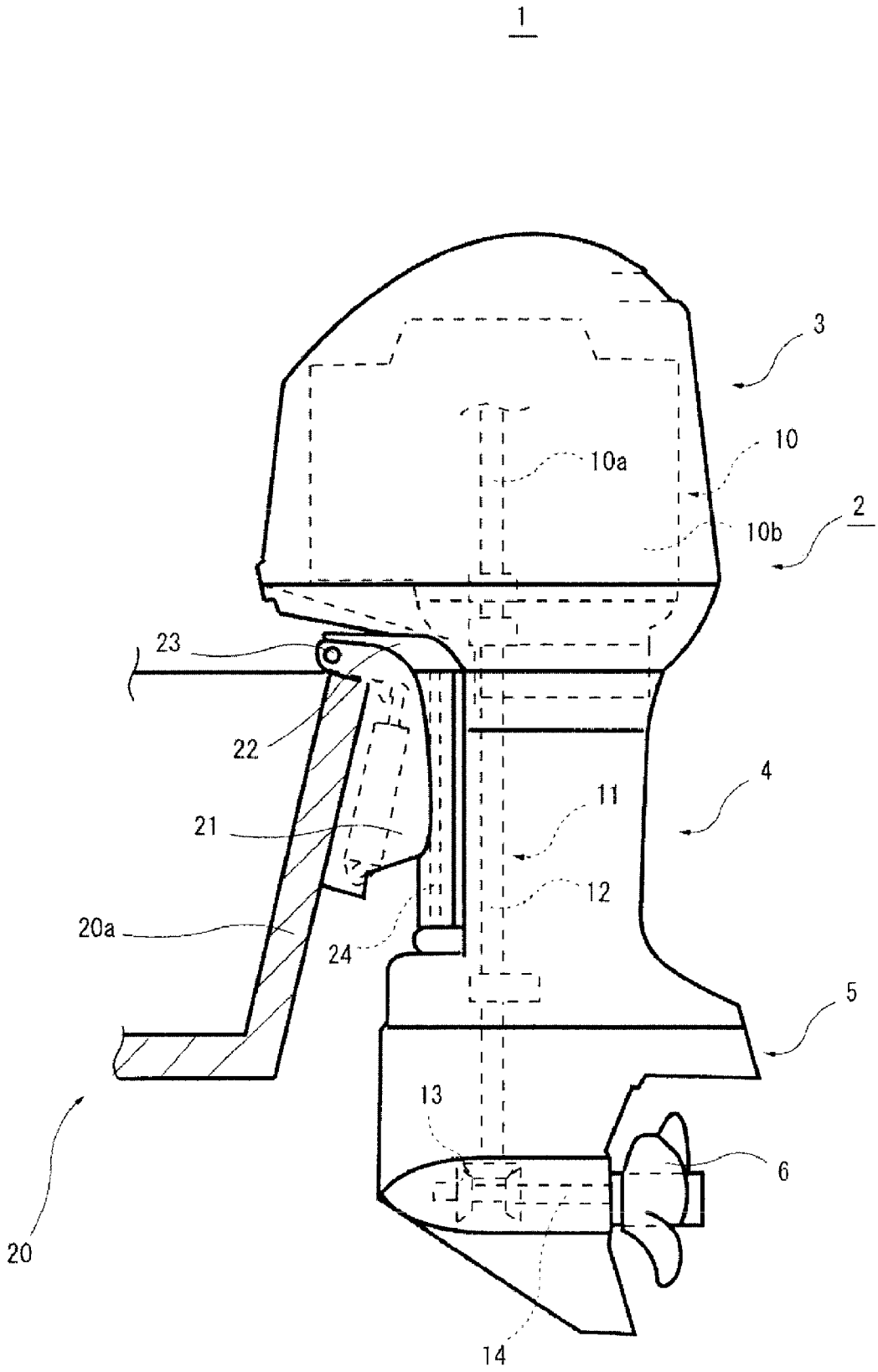
FIG. 1 is a schematic view of an outboard motor provided with a boat propulsion system according to a preferred embodiment of the present invention.

FIG. 1 is a schematic view of an outboard motor 1 provided with the boat propulsion system according to a preferred embodiment of the present invention.

Structure of the Outboard Motor

The outboard motor 1 preferably includes a propulsion unit 2, and a housing thereof including a cowl 3, an upper case 4, and a lower case 5. The cowl 3 in an upper position houses an engine 10 in which a crankshaft 10*a* is vertically positioned. The lower case 5 in a lower position is provided with a propeller 6 that is driven to rotate by the engine 10. The engine 10 has a cylinder 10*b* that is located in a position on an opposite side of a hull 20 in relation to the crankshaft 10*a*. The upper case 4 and the lower case 5 house a power transmission mechanism 11 from the crankshaft 10*a* of the engine 10, an exhaust passage, and so forth (not shown). The engine 10 drives and rotates the propeller 6 via the power transmission mechanism 11. The power transmission mechanism 11 preferably includes a drive shaft 12, a shift change mechanism 13, a propeller shaft 14, and so forth. Rotation of the engine 10 is transmitted to the drive shaft 12. The shift change mechanism 13 converts rotation of the drive shaft 12 into rotation at right angles to rotate the propeller shaft 14.

The outboard motor 1 is mounted on a rear end of the hull 20. A clamp bracket 21 is fixed on a tailboard 20*a* of the hull 20. The clamp bracket 21 has a swivel bracket 22 rotatably pivotally attached by a tilt shaft 23. The swivel bracket 22 has the propulsion unit 2 pivotally attached to be rotatable around a steering shaft 24.

Shift Change Mechanism

Figure 2:
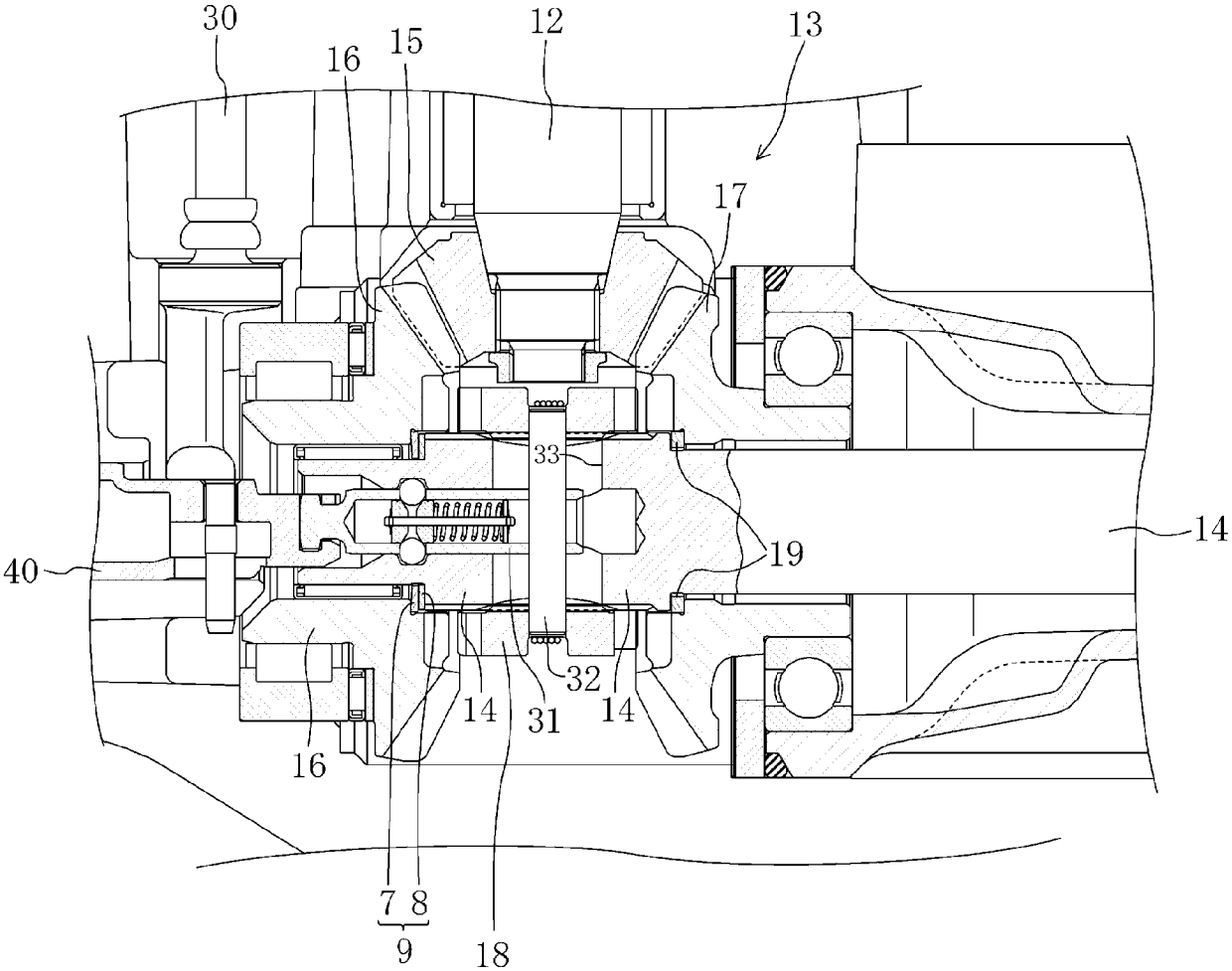
FIG. 2 is a cross-sectional view of a shift change mechanism and surroundings thereof according to a preferred embodiment of the present invention.

FIG. 2 is a cross-sectional view of a shift change mechanism 13 and surroundings thereof. In the shift change mechanism 13, a dog clutch 18 that rotates with the propeller shaft 14 meshes together with either of a forwarding bevel gear 16 or a reversing bevel gear 17 that constantly meshes together with a drive bevel gear 15 fixed on a lower end of the drive shaft 12. Forward movement and reverse movement are thereby switched. This switching is performed by operation of a shift lever in the hull. When the shift lever is operated, a shift rod 30 provided on a front side of the outboard motor 1 is rotated in either the clockwise direction or the counter-clockwise direction. As a result of this rotation, a shift sleeve 40, a pin 32, and the dog clutch 18 located in front of the propeller shaft 14 moves along the axial direction of the propeller shaft 14 to either the front or the rear. Thus, the output can be shifted between forward, neutral, and reverse. FIG. 2 shows a neutral state where the dog clutch 18 does not mesh together with either of the forwarding bevel gear 16 or the reversing bevel gear 17. The boat propulsion system in this preferred embodiment is provided with the drive bevel gear 15, the forwarding bevel gear 16, the reversing bevel gear 17, and the dog clutch 18.

The dog clutch 18 is preferably provided by spline fitting and is slidable in the longitudinal direction in relation to an outer circumference of the propeller shaft 14 and non-rotatable in relation to the propeller shaft 14. Moreover, both ends of the pin 32 that pass through a long opening 33 formed in the propeller shaft 14 are connected to the dog clutch 18. The pin 32 is moved in the rear direction or in the front direction by a plunger 31 disposed in the propeller shaft 14. Consequently, the dog clutch 18 meshes together with the forwarding bevel gear 16 or the reversing bevel gear 17. The long opening 33 is open longer in the axial direction of the propeller shaft 14.

The propeller 6 rotates to generate propulsive force in the axial direction of the propeller shaft 14, which is transmitted to the hull 20 from the propeller shaft 14 via the forwarding bevel gear 16 or the reversing bevel gear 17. While the propulsive force is transmitted, the propeller shaft 14 comes in contact with the forwarding bevel gear 16 via a forwarding side buffer member 9 or in contact with the reversing bevel gear 17 via a reversing side buffer member 19. In other words, the propeller shaft 14 comes directly in contact with the forwarding side buffer member 9, the forwarding side buffer member 9 comes directly into contact with the forwarding bevel gear 16, but the propeller shaft 14 and the forwarding bevel gear 16 are not directly in contact with each other. A relationship between the propeller shaft 14 and the reversing bevel gear 17 is the same as described above. The forwarding side buffer member 9 and the reversing side buffer member 19 prevent abrasions caused by direct contact between the propeller shaft 14, the forwarding bevel gear 16, and the reversing bevel gear 17. The dog clutch 18 does not mesh together with either of the forwarding bevel gear 16 and the reversing bevel gear 17 in the neutral state, where torque is not transmitted between the dog clutch 18 and both bevels gears 16, 17. The two buffer members 9, 19 are not in contact with the dog clutch 18 or with the bevel gears 16, 17 or are in contact only to rotate together.

Forwarding Side Buffer Member

The forwarding side buffer member 9 will be further described hereinafter with reference to FIG. 3.

Figure 3:
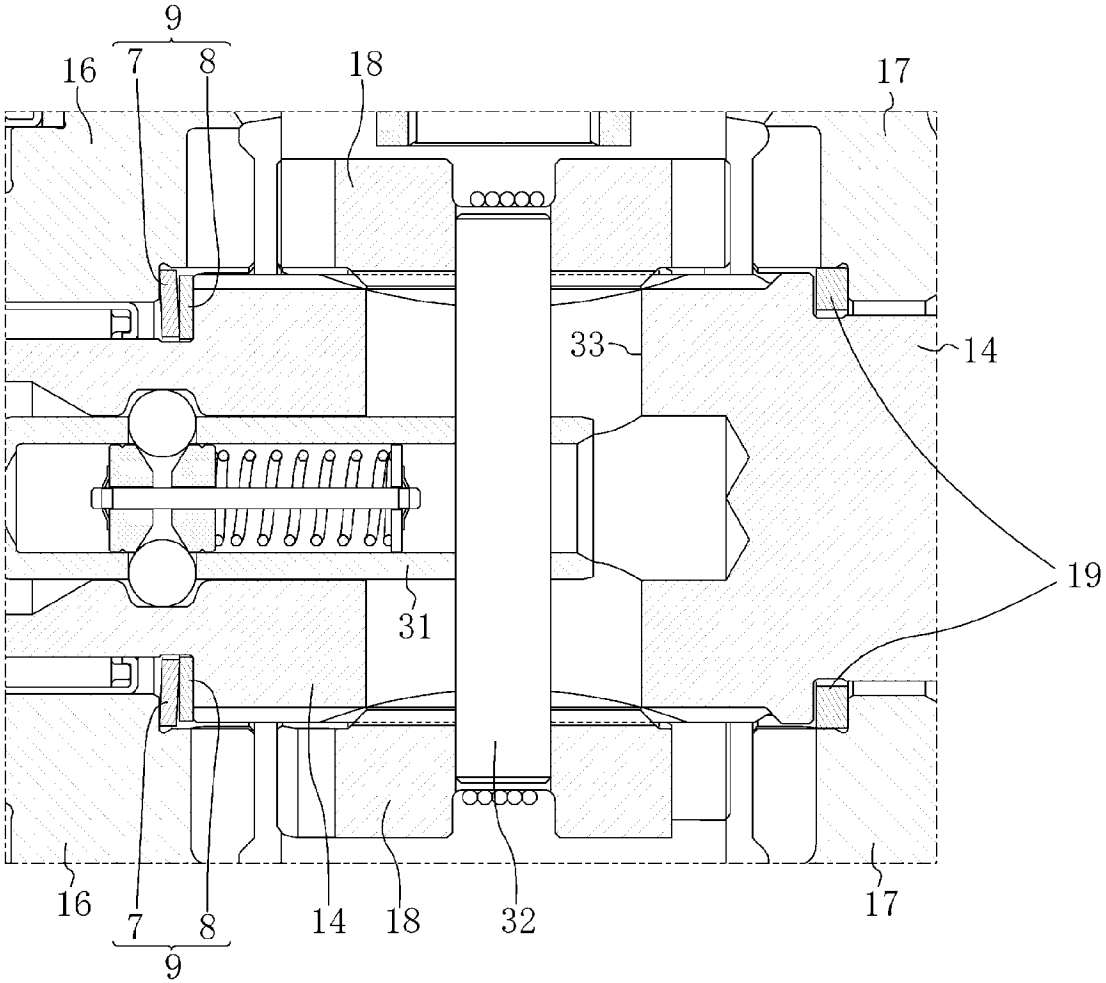
FIG. 3 is an enlarged view of a center portion of FIG. 2.

As shown in FIG. 3, the forwarding side buffer member 9 in this preferred embodiment is provided with an elastic member defined by a disc spring 7 and a shim member 8. The shim member 8 is a member that is pinched between two objects to adjust a space (gap) between the two objects. Here, the shim member 8 preferably is a disk in the shape of a doughnut (with an opening formed at the center) made from a flat plate. The forwarding side buffer member 9 is disposed in the order of the forwarding bevel gear 16, the disc spring 7, the shim member 8, and the propeller shaft 14.

The arrangement described above can prevent, minimize, and weaken the generation of impact and sound when variations in thrust force occur. Specifically, when variations in rotational speed or torque of the engine 10 occur, thrust force (propulsive force) on the forwarding side applied to the propeller shaft 14 varies. As a result, the distance between the propeller shaft 14 and the forwarding bevel gear 16 varies. Therefore, the forwarding bevel gear 16, the disc spring 7, the shim member 8, and the propeller shaft 14 either separate from each other or come in contact with each other to push each other. This causes an impact and generates sound. However, when the disc spring 7 defining the elastic member is deformed, the variations in the distance mentioned above can be offset to a large extent. Impact and sound are generated when the propeller shaft 14 and the forwarding bevel gear 16 that are spaced away from each other come closer to each other once again as a result of thrust force in the forward direction and collide with each other via the forwarding side buffer member 9. However, the disc spring 7 deforms itself to absorb force of the impact. Therefore, it is possible to prevent and minimize the generation of impact and sound.

Variations (irregularities) in thrust force caused by variations (irregularities) in rotational speed and variations (irregularities) in torque of the engine 10 are at a maximum in a state of a shift-in. Therefore, a shift change and a shift-in will be described hereinafter.

Shift Change and Shift-In

Figure 4:
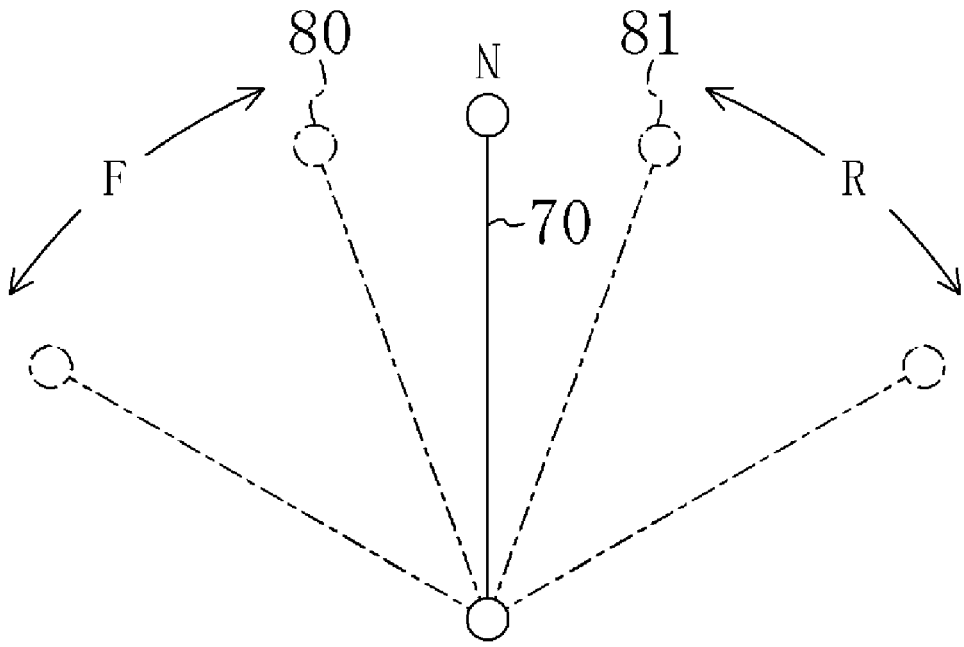
FIG. 4 is a schematic view of the operation of a shift lever according to a preferred embodiment of the present invention.

FIG. 4 is a schematic drawing showing a shift lever 70 through which an operator performs shift change operation. When the shift lever 70 is in a position illustrated with a solid line in the drawing, the shift change mechanism 13 is in the neutral state. Accordingly, the dog clutch 18 does not mesh together with either of the forwarding bevel gear 16 and the reversing bevel gear 17. When the shift lever 70 is inclined in a direction on the left side of the drawing, a shift-in state on the forward side occurs at a position inclined by about 20 degrees, for example, from a neutral position as denoted by reference numeral 80.

A shift-in is a state where the dog clutch 18, originally in the neutral state, starts to mesh together with the forwarding bevel gear 16 or the reversing bevel gear 17. In the shift-in state, rotational speed of the engine 10 is maintained at a relatively low rotation at a certain rotational speed (for example, about 700 rpm in this preferred embodiment). Further, the drive shaft 12 rotates at a certain rotational speed in a similar manner. When the shift lever 70 is further inclined to the left, rotational speed of the engine 10 becomes higher while the dog clutch 18 keeps meshing together with the forwarding bevel gear 16. Thus, the propeller shaft 14 rotates to the forward side according to the rotational speed.

On the other hand, when the shift lever 70 is inclined to the right side of the drawing from the neutral position, the shift-in state on the reversing side occurs at a position inclined by about 20 degrees, for example, as denoted by reference numeral 81. When the shift lever 70 is further inclined to the right, rotational speed of the engine 10 becomes higher while the dog clutch 18 keeps meshing together with the reversing bevel gear 17. Accordingly, the propeller shaft 14 rotates to the reverse side according to the rotational speed.

When the shift lever 70 is located between the shift-in position 80 on the forward side and the shift-in position 81 on the reverse side, the engine 10 and the drive shaft 12 rotate at a certain constant low rotational speed. When the neutral state changes to the shift-in state, the dog clutch 18 in a halt condition meshes together with the rotating forwarding bevel gear 16 or the rotating reversing bevel gear 17. Therefore, the engine rotational speed at this time is made as low as possible. Thus, it is prevented that the dog clutch 18 is bounced back and becomes unable to perform meshing or becomes damaged.

At a time of a shift-in, a rotational speed of the engine 10 is low. Therefore, even when rotational speed changes a little, or even when torque of the engine 10 changes a little, a ratio of variations (irregularities) in propulsive force generated by the propeller 6 becomes relatively larger as compared to the occasion when rotational speed of the engine 10 is high. In addition, as rotational speed of the engine 10 is low, engine sound is relatively small. Therefore, impact and sound generated by variations in thrust force are larger as compared to the occasion when rotational speed of the engine 10 is high. Accordingly, an effect to prevent and minimize generation of impact and sound of the forwarding side buffer member 9 including the disc spring 7 of this preferred embodiment is more advantageously performed in the state of a shift-in.

Details of Buffer Member

The forwarding side buffer member 9 preferably includes the shim member 8 and the disc spring 7. The shim member 8 enables adjustment of each distance between the forwarding bevel gear 16, the forwarding side buffer member 9, and the propeller shaft 14 in the neutral state. There is a certain error range concerning sizes and assembly accuracy of each element or component of the boat propulsion system. Therefore, even when only the disc spring 7 is provided, there may be a case where impact generated by variations in thrust force is not completely absorbed by elastic deformation of the disc spring 7 because the distance between the forwarding bevel gear 16 and the distance between the forwarding side buffer member 9 and the propeller shaft 14 become too large. However, in this preferred embodiment, the distance is adjusted by the shim member 8. Therefore, absorption of impact force by the disc spring 7 is most effectively performed.

In this preferred embodiment, the disc spring 7 is disposed in a position closer to the forwarding bevel gear 16 than the shim member 8. Further, the forwarding bevel gear 16, the disc spring 7, the shim member 8, and the propeller shaft 14 are disposed in this order. Spline processing is performed for the propeller shaft 14 to enable spline fitting with the dog clutch 18. Consequently, there may be a burr on a surface in contact with the forwarding side buffer member 9 caused by the spline processing. If the burr comes in contact with the disc spring 7, the disc spring 7 may be damaged, and elasticity may decrease. Therefore, the shim member 8 is in contact with the propeller shaft 14 in an arrangement of this preferred embodiment.

In addition, the reversing side buffer member 19 is disposed between the reversing bevel gear 17 and the propeller shaft 14. The reversing side buffer member 19 preferably includes a shim member, which reduces distance between the reversing bevel gear 17 and the propeller shaft 14 and, at the same time, prevents the reversing bevel gear 17 and the propeller shaft 14 from coming in direct contact with each other to cause friction. An impact force of the reversing bevel gear 17 and the propeller shaft 14 is smaller than an impact force of the forwarding bevel gear 16 and the propeller shaft 14. Even if an elastic member is not included in the reversing side buffer member 19, impact and sound generated by variations in thrust force can be made sufficiently small by reducing the distance with the shim member.

In addition, the disc spring 7 and the shim member 8 of the forwarding side buffer member 9 preferably are made of a hard alloy containing iron, for example. Further, the reversing side buffer member 19 is made of a soft alloy containing copper such as the one used for a bearing or the like. Accordingly, material for the reversing side buffer member 19 has a hardness lower than that of material of the forwarding side buffer member 9 and, thereby, is softer. As for relative rotational speed between the propeller shaft 14 and the bevel gears 16, 17, the one on the reverse side is higher than that of the forward side. Therefore, the one on the reverse side needs countermeasures against friction. However, in the present preferred embodiment, alloy containing copper, which is an alloy different from the propeller shaft 14 and the bevel gears 16, 17 made of an alloy containing iron, is used for the reversing side buffer member 19. Consequently, seizure does not easily happen. In addition, lubricating oil is well retained. Therefore, lubricity is kept high. The thickness of the reversing side buffer member 19 (thickness along the axial direction of the propeller shaft) is larger than the thickness of the disc spring 7 or the shim member 8 of the forwarding side buffer member 9 (thickness along the axial direction of the propeller shaft). Specifically, the disc spring 7 and the shim member 8 of the forwarding side buffer member 9 is preferably made of SK5 (carbon tool steel), but could be made of carbon steel or alloyed steel, for example.

When the shift change mechanism 13 of this preferred embodiment is in the shift-in state of the forward side, the propeller shaft 14 comes in contact with the forwarding bevel gear 16 via the forwarding side buffer member 9 due to a thrust force on the forwarding side generated by rotation of the propeller 6 and, thus, pushes the forwarding bevel gear 16. In this state, a ratio of elastic deformation of the disc spring 7 does not reach 100%. Therefore, further elastic deformation is possible. In other words, because the thrust force caused by rotation of the propeller 6 is relatively small at the engine rotational speed at the time of a shift-in, ratio of elastic deformation of the disc spring 7 does not reach 100%. Therefore, even if the thrust force varies in the shift-in state on the forward side, variations in the force can be absorbed by further deformation of the disc spring 7. Moreover, when the rotational speed of the engine 10 is increased from the shift-in state, the thrust force becomes large. Accordingly, a ratio of elastic deformation of the disc spring 7 becomes gradually larger. Then, before rotational speed of the engine 10 reaches the maximum, elastic deformation of the disc spring 7 reaches the limit, and the disc spring 7 becomes generally flat. Here, if it is assumed that the disc spring 7 is free to cause further elastic deformation with the engine 10 at the maximum rotational speed, vibration becomes large or continues for a long time as a result of variations in thrust force at the time when rotational speed is low.

Other Preferred Embodiments

The preferred embodiments described above are merely non-limiting examples of the present invention and the present invention is in no way limited by these examples. For instance, the reversing side buffer member 19 may be made to have the same structure as the forwarding side buffer member 9 to include the disc spring 7. If the forwarding side buffer member 9 is defined only by the disc spring 7, its effect is inferior to the above preferred embodiments. However, a sufficient practical effect can be still obtained. In addition, an object other than the disc spring 7, such as a wave washer, for example, may be used as the elastic member of the forwarding side buffer member 9.

As shown in FIG. 3, the disc spring 7 of the forwarding side buffer member 9 in the above preferred embodiments preferably is a disk with an opening arranged at the center and is disposed such that its outer circumferential side is in contact with the forwarding bevel gear 16. On the other hand, the disk may be disposed such that an inner circumferential side is in contact with the forwarding bevel gear 16. When the disk is arranged such that the outer circumferential side of the disc spring 7 is in contact with the bevel gear 16 as is shown in FIG. 3, tensile strength applied to the disc spring 7 becomes smaller as compared to another arrangement. This is preferable because the disc spring 7 is not easily destroyed.

In addition, preferred embodiments of the present invention can be applied not only to an outboard motor but also to an inboard motor and an inboard-outdrive motor (a so-called stern drive).

As described above, the boat propulsion system according to the preferred embodiments of the present invention prevents, minimizes, and eliminates generation of impact and sound resulting from variations of thrust force and is useful for an outboard motor and other vehicles.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:

a drive bevel gear fixed on a lower end of a drive shaft arranged to rotate in one direction;

a forwarding bevel gear and a reversing bevel gear rotatably fitted on a propeller shaft and meshing together with the drive bevel gear;

a dog clutch mounted on the propeller shaft and rotatable with the propeller shaft, arranged to move in an axial direction of the propeller shaft, and meshes together with the forwarding bevel gear or the reversing bevel gear to rotate the propeller shaft; and a forwarding side buffer member; wherein the propeller shaft is arranged to contact with the forwarding bevel gear via the forwarding side buffer member;

the forwarding side buffer member includes at least an elastic member that is arranged to be elastically deformed between the propeller shaft and the forwarding bevel gear; and the forwarding side buffer member is in direct contact with the forwarding bevel gear.

2. The boat propulsion system according to claim 1, wherein the forwarding side buffer member further includes a shim member.

3. The boat propulsion system according to claim 2, wherein the elastic member is disposed in a position that is closer to the forwarding bevel gear than the shim member.

4. The boat propulsion system according to claim 2, further comprising a reversing side buffer member, wherein the propeller shaft is arranged to contact with the reversing bevel gear via the reversing side buffer member.

5. The boat propulsion system according to claim 4, wherein the elastic member and the shim member are made of an alloy containing iron; and the reversing side buffer member is made of an alloy containing copper and has a hardness smaller than that of the elastic member.

6. The boat propulsion system according to claim 4, wherein a thickness of the reversing side buffer member along the axial direction of the propeller shaft is larger than a thickness of either the elastic member or the shim member along the axial direction of the propeller shaft.

7. The boat propulsion system according to claim 1, further comprising a reversing side buffer member, wherein the propeller shaft is arranged to contact with the reversing bevel gear via the reversing side buffer member.

8. The boat propulsion system according to claim 7, wherein the elastic member is made of an alloy containing iron; and the reversing side buffer member is made of an alloy containing copper and has a hardness smaller than that of the elastic member.

9. The boat propulsion system according to claim 1, wherein a ratio of elastic deformation of the elastic member is a ratio in which further elastic deformation is possible when the dog clutch meshes together with the forwarding bevel gear, and when the drive shaft rotates at a rotational speed of a shift-in state.

10. The boat propulsion system according to claim 9, wherein the elastic member reaches a limit of elastic deformation when the dog clutch meshes together with the forwarding bevel gear, and before a rotational speed of the drive shaft becomes larger than the rotational speed of a shift-in state and reaches a maximum rotational speed.

11. The boat propulsion system according to claim 1, wherein the elastic member is a disc spring.

12. The boat propulsion system according to claim 11, wherein the disc spring is generally in a flat state when the dog clutch meshes together with the forwarding bevel gear, and before a rotational speed of the drive shaft becomes larger than a rotational speed of a shift-in state and reaches a maximum rotational speed.

13. A boat propulsion system comprising:

a drive bevel gear fixed on a lower end of a drive shaft arranged to rotate in one direction;

a forwarding bevel gear and a reversing bevel gear rotatably fitted on a propeller shaft and meshing together with the drive bevel gear;

a dog clutch mounted on the propeller shaft and rotatable with the propeller shaft, arranged to move in an axial direction of the propeller shaft, and meshes together with the forwarding bevel gear or the reversing bevel gear to rotate the propeller shaft; and a reversing side buffer member; wherein the propeller shaft is arranged to contact with the reversing bevel gear via the reversing side buffer member;

the reversing side buffer member includes at least an elastic member that is arranged to be elastically deformed between the propeller shaft and the reversing bevel gear; and the reversing side buffer member is in direct contact with the reversing bevel gear.

14. A boat propulsion system comprising:

a drive bevel gear fixed on a lower end of a drive shaft arranged to rotate in one direction;

a forwarding bevel gear and a reversing bevel gear rotatably fitted on a propeller shaft and meshing together with the drive bevel gear;

a dog clutch mounted on the propeller shaft and rotatable with the propeller shaft, arranged to move in an axial direction of the propeller shaft, and meshes together with the forwarding bevel gear or the reversing bevel gear to rotate the propeller shaft;

a forwarding side buffer member; and a reversing side buffer member; wherein the propeller shaft is arranged to contact with the forwarding bevel gear via the forwarding side buffer member;

the propeller shaft is arranged to contact with the reversing bevel gear via the reversing side buffer member; and the forwarding side buffer member is in direct contact with the forwarding bevel gear or the reversing side buffer member is in direct contact with the reversing bevel gear.

* * * * *